United States Patent [19]

Waiser

[11] Patent Number: 4,461,111

[45] Date of Patent: Jul. 24, 1984

[54] REVOLVER TRIGGER SAFETY INTERLOCK

[76] Inventor: Shimon Waiser, 435 Ocean Pkwy., Apt. 5H, Brooklyn, N.Y. 11218

[21] Appl. No.: 417,420

[22] Filed: Sep. 13, 1982

[51] Int. Cl.[3] ..... F41C 17/02

[52] U.S. Cl. ..... 42/66

[58] Field of Search ..... 42/66, 67

[56] References Cited

U.S. PATENT DOCUMENTS 339,149 4/1886 Cilley ..... 42/67
391,213 10/1888 Torkelson ..... 42/67
887,784 5/1908 Fyrberg ..... 42/66
2,863,249 12/1958 Koucky et al. ..... 42/66
3,701,213 10/1972 Lewis ..... 42/66

*Primary Examiner*—Charles T. Jordan

[57] ABSTRACT

A revolver has a trigger safety interlock blocking the trigger in an initial position if none of the circumferentially chambers of a cylinder are axially aligned with the revolver bore. This interlock consisting of at least two elements one of which is the trigger itself and the second one is a cylinder latch itself. This interlock is built such that the trigger is engaged by another part of the interlock such that the trigger becomes immovable.

2 Claims, 4 Drawing Figures

REVOLVER TRIGGER SAFETY INTERLOCK

This invention relates to revolvers and more particularly to safety interlocks blocking a trigger in an initial position if none of the circumferentially disposed cartridge-receiving chambers of the cylinder are axially aligned with a revolver bore.

Up to this date many different constructions of semi-automatic revolvers have been patented. Those constructions have not had one very important safety interlock—after the last shot a hammer of a gun remained in a cocked position and after reloading of a cylinder the latter could be inserted in a gun frame out of firing position with none of the circumferentially disposed cartridge-receiving chambers of the cylinder axially aligned with the revolver bore. In such a case, if the hammer struck a cap, a bullet could not enter smoothly into a bore of the gun and a result could be bad both for the gun and for a shooter.

This problem was obviated in my U.S. patent applications Ser. Nos. 06/373,625 and 06/387,I66.

In the present invention this problem has been obviated in a novel manner.

It is therefore the principal object of the present invention to provide a novel, simpler and improved safety interlock blocking a trigger in an initial position if none of the circumferentially disposed cartridge-receiving chambers of the cylinder are axially aligned with a revolver bore.

Here two different variations of a safety interlock which can be built with this invention are presented.

Figure 1:
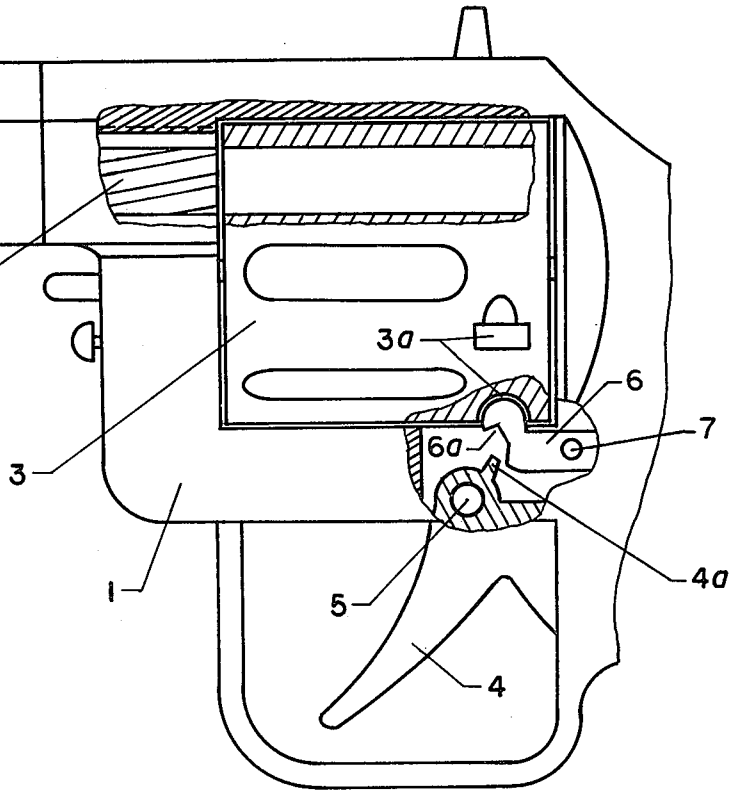
FIG. 1 is a fragmentary view, partly in section, of the left hand side of a revolver with the interlock of the first variation, according to the present invention while the gun is in trigger-released position and one of the circumferentially disposed cartridge-receiving chambers of the cylinder is axially aligned with the revolver bore.
Figure 2:
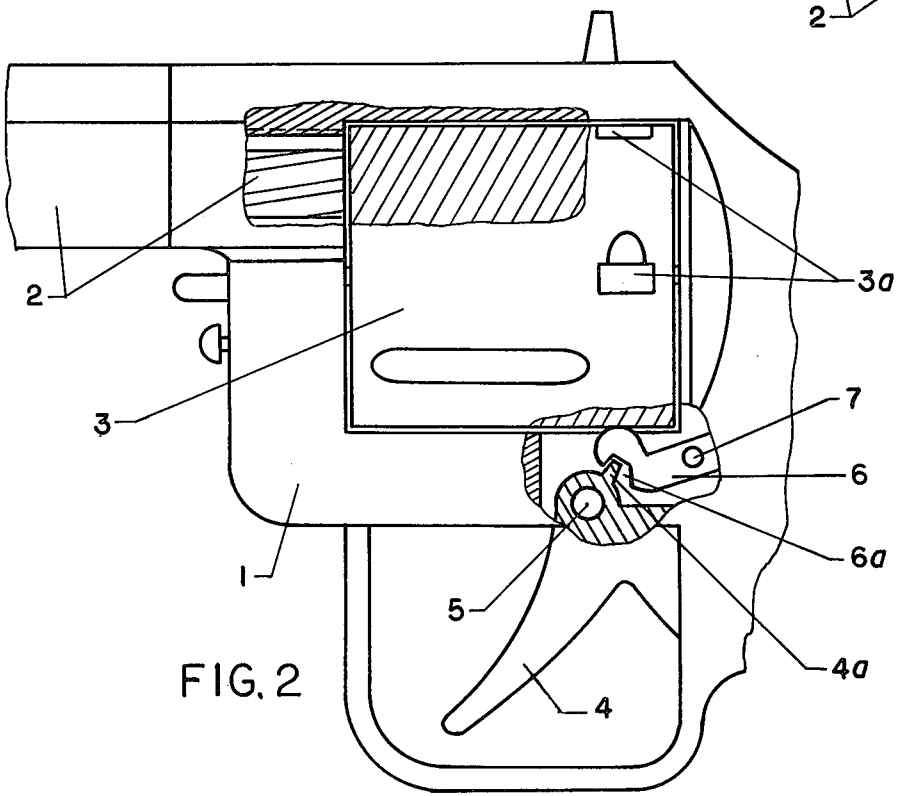
FIG. 2 is a fragmentary view, partly in section, of the left hand side of a revolver with the interlock of the first variation, according to the present invention while the gun is in trigger-released position and none of the circumferentially disposed cartridge-receiving chambers of the cylinder are axially aligned with the revolver bore.

Referring first to FIG. 1 and FIG. 2 wherein the first modification of the interlock is shown. The revolver shown in these drawings comprises, in its major components, a frame 1; a barrel 2; a rotatably mounted cylinder 3 in the frame, having special recesses 3*a* in it to be engaged by a cylinder latch 6, when one of the circumferentially disposed cartridge-receiving chambers of the cylinder is axially aligned with the revolver bore; a hammer (not shown) is pivotally mounted in the frame; a trigger 4 is pivotally mounted in the frame by a pivot pin 5 and has a special projection 4*a;* a hand (not shown) for rotation of the cylinder when the hammer is being cocked; and the cylinder latch 6 releasably engaging the cylinder recesses 3*a* to prevent rotation of the cylinder when the revolver is fired, and which is pivotally mounted in the frame by a pivot pin 7 and has a special recess 6*a* in it.

As it can be seen in FIG. 1, where the cylinder 3 is shown in firing position, the latch 6 enters in the recess 3*a* of the cylinder 3 preventing rotation of the latter. The trigger 4 may be pushed and rotated counter-clockwise because its special projection 4*a* is out of the special recesses 6*a* in the latch 6 and nothing prevents the trigger 4 from being rotated counter-clockwise. If the hammer was already cocked, then turning the trigger 4 counter-clockwise a shooter thereby disengages the hammer and the latter will fly forward and hit a cartridge cap.

In FIG. 2 another relative position of the cylinder 3 and the latch 6 is shown. The cylinder 3 is out of firing position and therefore the latch 6 is out of the recess 3*a* of the cylinder 3 and is rotated a little counter-clockwise. The special projection 4*a* of the trigger 4 enters in the special recess 6*a* of the latch 6 thus preventing rotation of the trigger 4 counter-clockwise. Now if the hammer was already cocked it can not fly forward since it can not be disengaged from the trigger which is immovable in this position.

Figure 3:
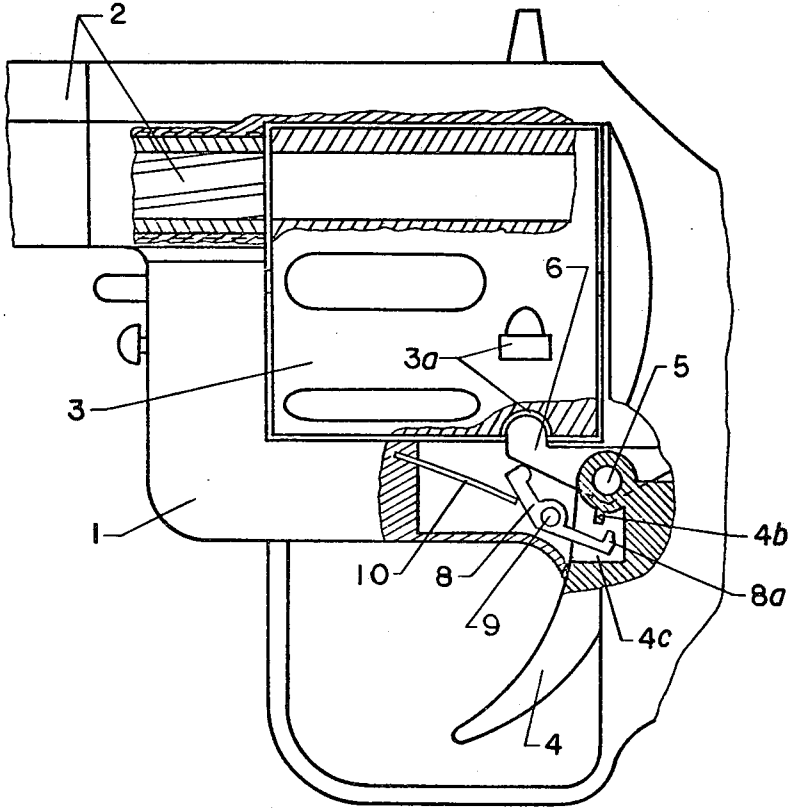
FIG. 3 is a fragmentary view, partly in section, of the left hand side of a revolver with the interlock of the second variation, according to the present invention while the gun is in trigger-released position and one of the circumferentially disposed cartridge-receiving chambers of the cylinder is axially aligned with the revolver bore.
Figure 4:
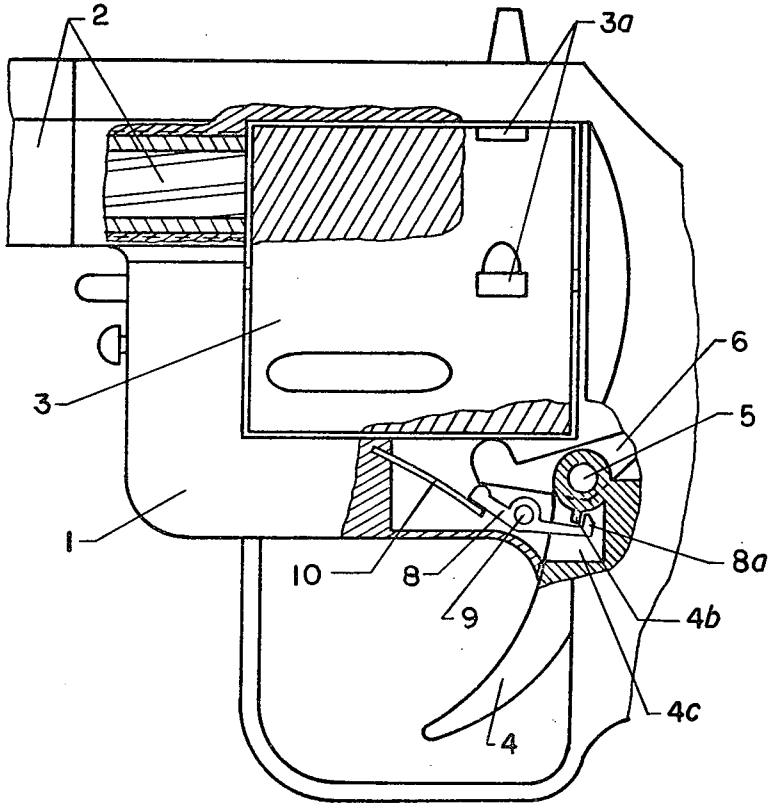
FIG. 4 is a fragmentary view, partly in section, of the left hand side of a revolver with the interlock of the second variation, according to the present invention while the gun is in trigger-released position and none of the circumferentially disposed cartridge-receiving chambers of the cylinder are axially aligned with the revolver bore.

In FIG. 3 and FIG. 4 the second modification of the interlock is shown. The revolver shown in these drawings comprises, in its major components, a frame 1; a barrel 2; a rotatably mounted cylinder 3 in the frame, having special recesses 3*a* in it to be engaged by a cylinder latch 6, when one of the circumferentially disposed cartridge-receiving chambers of the cylinder is axially aligned with the revolver bore; a hammer (not shown) is pivotally mounted in the frame; a pivoted trigger 4, having a special projection 4*b* located in a recess 4*c;* a hand (not shown) for rotation of the cylinder when the hammer is being cocked; the cylinder latch 6 releasably engaging the cylinder recesses 3*a* to prevent rotation of the cylinder when the revolver is fired, and which is pivotally mounted in the frame by a pivot pin 5 servicing simultaneously for mounting of the trigger 4; an additional lever 8 is pivotally mounted in the frame by a pivot pin 9 and has on its right end a tooth 8*a* to engage the projection 4*b* of the trigger 4; a cylinder latch spring 10 is fastened to the frame and presses the lever 8 which passes this effort to the latch 6 thus pressing the latter to the surface of the cylinder 3.

As it can be seen in FIG. 3, where the cylinder 3 is shown in firing position, the latch 6 enters in the recesses 3*a* of the cylinder 3 preventing rotation of the latter. The trigger 4 may be pushed and rotated counter-clockwise because its spiral projection 4*b* is not engaged by the tooth 8*a* of the lever 8 and nothing prevents the trigger 4 from being rotated counter-clockwise. If the hammer was already cocked, then turning the trigger 4 counter-clockwise a shooter thereby disengages the hammer and the latter will fly forward and hit a cartridge cap.

In FIG. 4 another relative position of the cylinder 3 and the latch 6 is shown. The cylinder 3 is out of firing position and therefore the latch 6 is out of the recess 3*a* of the cylinder 3 and is rotated a little counter-clockwise. Since the bottom part of the latch 6 is pressed to the left end of the lever 8 the latter is also turned counter-clockwise and its tooth 8*b* engages the projection 4*b* of the trigger 4, thus preventing rotation of the trigger 4 counter-clockwise. Now if the hammer was already cocked it can not fly forward since it can not be disengaged from the trigger which is immovable in this position.

Although but a few variations of the present invention have been illustrated and described, it will be apparent to those skilled in the art that various changes and modifications may be made therein without departing from the spirit of the invention or from the scope of the appended claims.

What is claimed is:

1. In a revolver having a frame, a barrel fixed in the frame, said barrel having a bore therein, a cylinder located in the frame, said cylinder having a plurality of circumferentially disposed cartridge-receiving chambers, a cylinder latch releasably engaging the cylinder to prevent rotation thereof, special recesses located in an external surface of the cylinder to be engaged by said cylinder latch, the improvement comprising a trigger safety interlock for preventing rotation of the trigger from its initial position when none of the circumferentially disposed cartridge-receiving chambers of the cylinder are axially aligned with the revolver bore, said safety interlock consisting of an engaging formation provided on said trigger and another engaging formation provided on said cylinder latch, said two engaging formations disposed one opposite another when said trigger is in its initial position and said engaging formation located on the cylinder latch engages the formation located on the trigger when the latter is in an initial position and the cylinder latch is out of said special recess in the external surface of the cylinder thus preventing rotation of the trigger.

2. In a revolver having a frame, a barrel fixed in the frame, said barrel having a bore therein, a cylinder located in the frame, said cylinder having a plurality of circumferentially disposed cartridge-receiving chambers, a cylinder latch releasably engaging the cylinder to prevent rotation thereof, special recesses located in an external surface of the cylinder to be engaged by said cylinder latch, the improvement comprising a trigger safety interlock for preventing rotation of the trigger from its initial position when none of the circumferentially disposed cartridge-receiving chambers of the cylinder are axially aligned with the revolver bore, said safety interlock consisting of an additional auxiliary lever being under the influence of said cylinder latch and provided with an engaging formation and another engaging formation provided on said trigger, said two engaging formations disposed one opposite another when said trigger is in an initial position and said engaging formation located on said additional auxiliary lever engages the formation located on the trigger when the latter is in an initial position and the cylinder latch is out of said special recess in the external surface of the cylinder thus preventing rotation of the trigger.

* * * * *